US005951387A

United States Patent [19]

Wen

[11] Patent Number: 5,951,387

[45] Date of Patent: Sep. 14, 1999

[54] TRIMMING DEVICE FOR A GRINDING WHEEL OF A GRINDING MACHINE

[76] Inventor: Ru-Luen Wen, No. 4, Lane 67, Shu Hsiao Rd., Taiping City, Taichung Hsien, Taiwan

[21] Appl. No.: 08/984,523

[22] Filed: Dec. 3, 1997

[51] Int. Cl.[6] ..... B24B 21/18

[52] U.S. Cl. ..... 451/443; 451/56

[58] Field of Search ..... 451/56, 72, 443; 125/11.02, 11.03, 11.21

[56] References Cited

U.S. PATENT DOCUMENTS

| | | | |
|---|---|---|---|
| 3,372,687 | 3/1968 | Grabowski | 125/11 |
| 3,938,492 | 2/1976 | Mercer, Jr. | 125/11 R |
| 4,071,015 | 1/1978 | Funke | 125/11 AT |
| 4,551,950 | 11/1985 | Unno et al. | 51/162.87 |
| 4,897,967 | 2/1990 | Maruyama et al. | 51/165.87 |
| 5,076,020 | 12/1991 | Negri | 51/5 D |

*Primary Examiner*—David A. Scherbel
*Assistant Examiner*—Dung Van Nguyen
*Attorney, Agent, or Firm*—Bacon & Thomas

[57] ABSTRACT

A wheel dressing device includes a supporting base axially defining a first passage therein and including a first end portion and a second end portion, a sliding tube slidably mounted in the first passage and including a first end portion and a second end portion extending outward of the second end portion of the supporting base, and a feed base fixedly mounted on the second end portion of the sliding tube to move therewith. The feed base axially defines a second passage along a direction perpendicular to that of the first passage and includes a first end portion and a second end portion. A feed tube is slidably mounted in the second passage and includes a first end portion and a second end portion. A wheel dressing head is fixedly mounted on the second end portion of the feed tube to move therewith.

5 Claims, 8 Drawing Sheets

TRIMMING DEVICE FOR A GRINDING WHEEL OF A GRINDING MACHINE

FIELD OF THE INVENTION

The present invention relates to a wheel dressing device, and more particularly to a wheel dressing device for a grinding wheel of a grinding machine.

BACKGROUND OF THE INVENTION

A conventional wheel dressing device for a grinding wheel of a grinding machine is shown in FIG. 8, and an illustration will follow in the detailed description of the preferred embodiments.

The present invention has arisen to mitigate and/or obviate the disadvantage of the conventional wheel dressing device.

SUMMARY OF THE INVENTION

In accordance with one aspect of the present invention, there is provided a wheel dressing device comprising a supporting base axially defining a first passage therein and including a first end portion and a second end portion, a sliding tube slidably mounted in the first passage and including a first end portion and a second end portion extending outward of the second end portion of the supporting base, and a feed base fixedly mounted on the second end portion of the sliding tube to move therewith.

The feed base axially defines a second passage along a direction perpendicular to that of the first passage and includes a first end portion and a second end portion. A feed tube is slidably mounted in the second passage and includes a first end portion and a second end portion. A wheel dressing head is fixedly mounted on the second end portion of the feed tube to move therewith.

Further features of the present invention will become apparent from a careful reading of the detailed description with appropriate reference to the accompanying drawings.

DETAILED DESCRIPTION OF THE PREFERRED EMBODIMENTS

Figure 8:
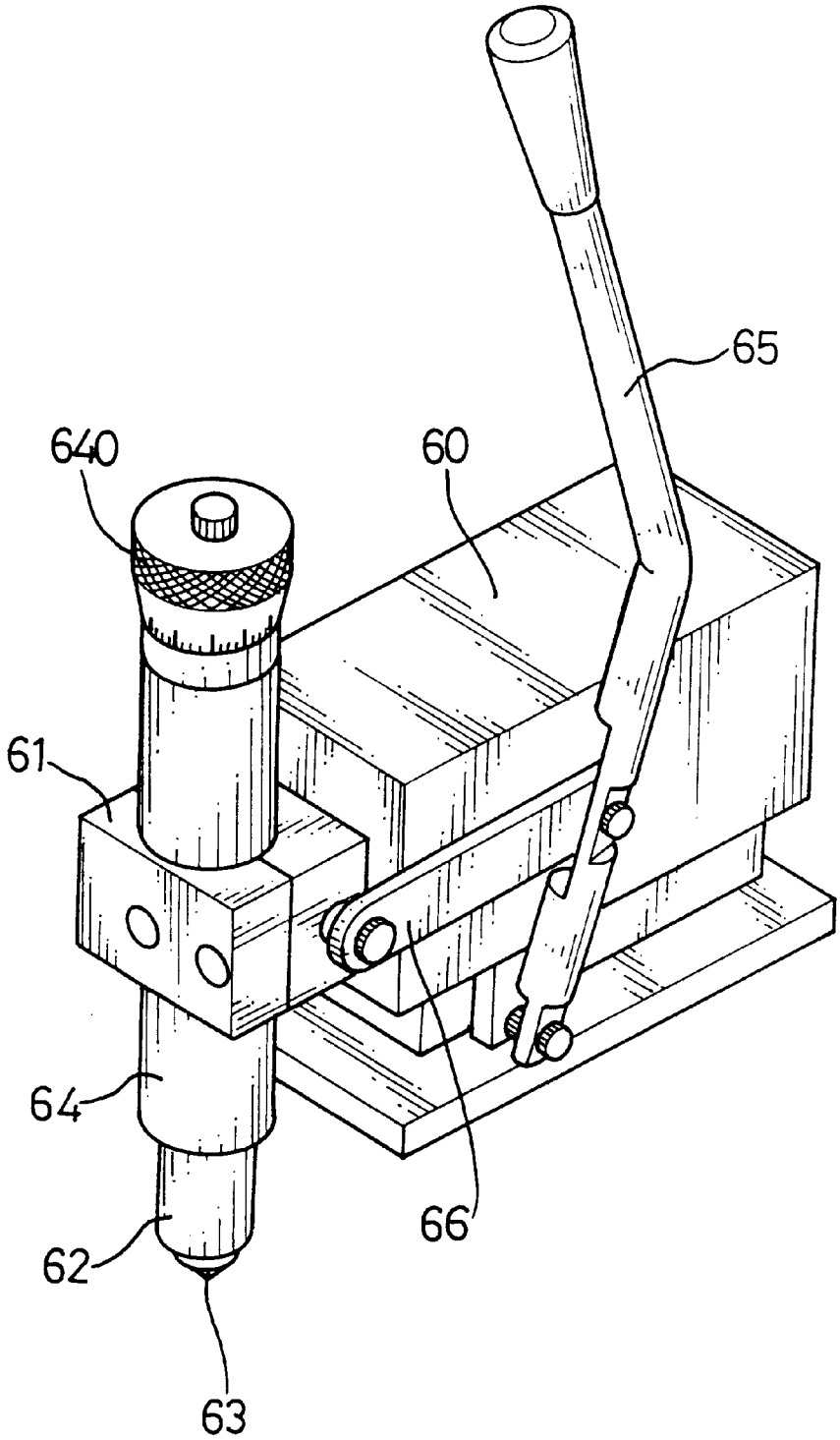
FIG. 8 PRIOR ART
FIG. 8 is a perspective view of a conventional wheel dressing device in accordance with the prior art.

For a better understanding of features and benefits of the present invention, reference is now made to FIG. 8, illustrating a conventional wheel dressing device for a grinding wheel in accordance with the prior art.

The conventional wheel dressing device can be adapted for wheel dressing a grinding wheel (not shown) of a grinding machine (not shown) and comprises a body 60, a feed base 61 slidably mounted on the body 60, a feed tube

64 fixedly mounted on the feed base 61 to displace therewith, a knob 640 rotatably mounted on the feed tube 64, a sliding rod 62 slidably mounted on the feed tube 64, a wheel dressing head 63 fixedly mounted on the sliding rod 62 to move therewith and located above an outer periphery of the grinding wheel, a control handle 65 pivotally mounted on the body 60, and a linking lever 66 pivotally connected between the feed base 61 and the control handle 65.

In operation, the feed base 61 can be moved outwardly along a horizontal direction by means of the control handle 65 such that the feed tube 64 together with the sliding rod 62 can be moved with the feed base 61 along the horizontal direction, thereby adjusting a horizontal displacement of the wheel dressing head 63 relative to the outer periphery of the grinding wheel to be dressed.

The knob 640 can then be rotated relative to the feed tube 64 so as to move the sliding rod 62 along a vertical direction, thereby in turn adjusting a vertical displacement of the wheel dressing head 63 relative to the outer periphery of the grinding wheel.

By such an arrangement, however, the horizontal and the vertical displacement of the wheel dressing head 63 relative to the grinding wheel is controlled manually, thereby easily causing a mispositioning and an error during operation.

Figure 1:
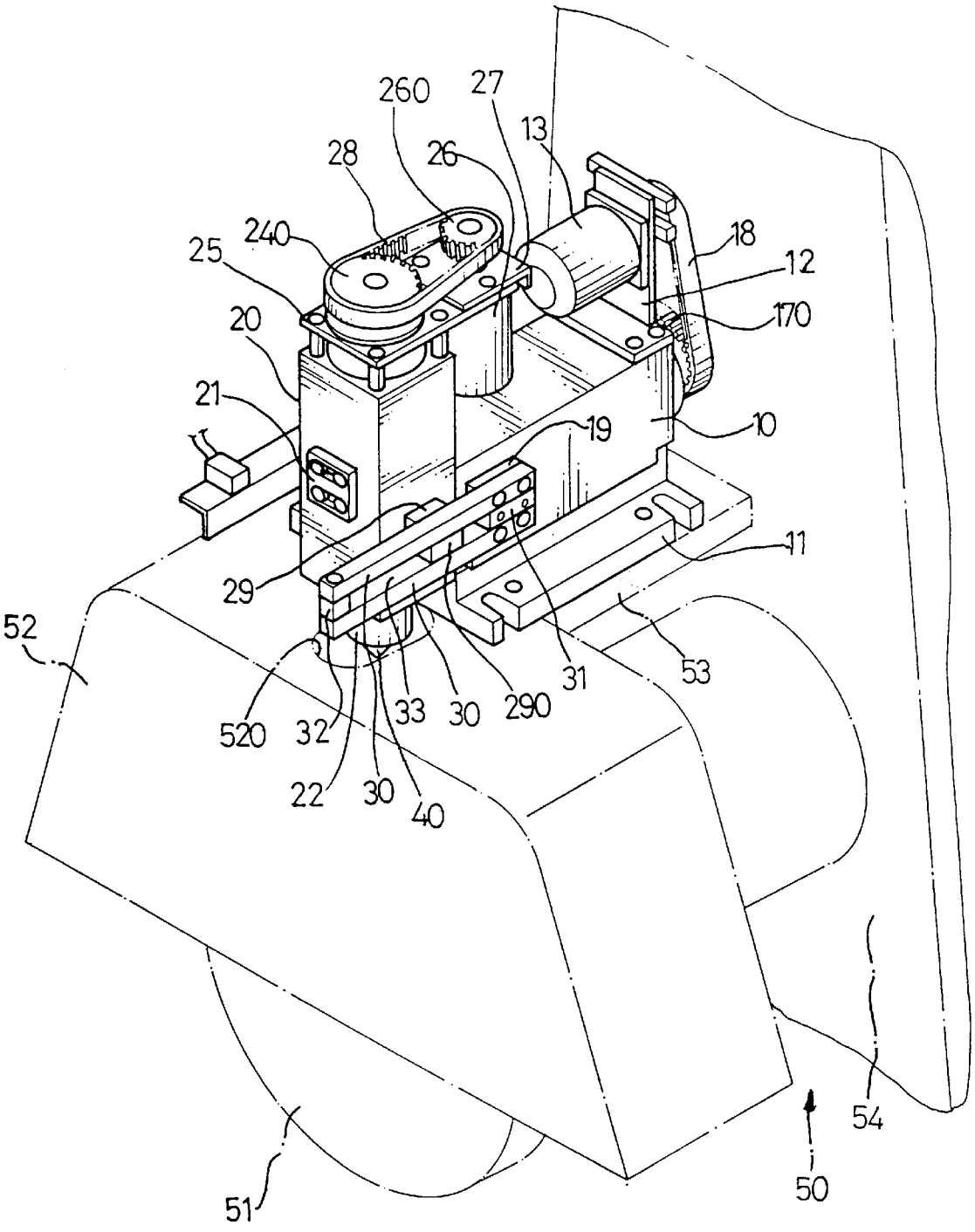
FIG. 1 is a perspective view of a wheel dressing device in accordance with a first embodiment of the present invention.
Figure 2:
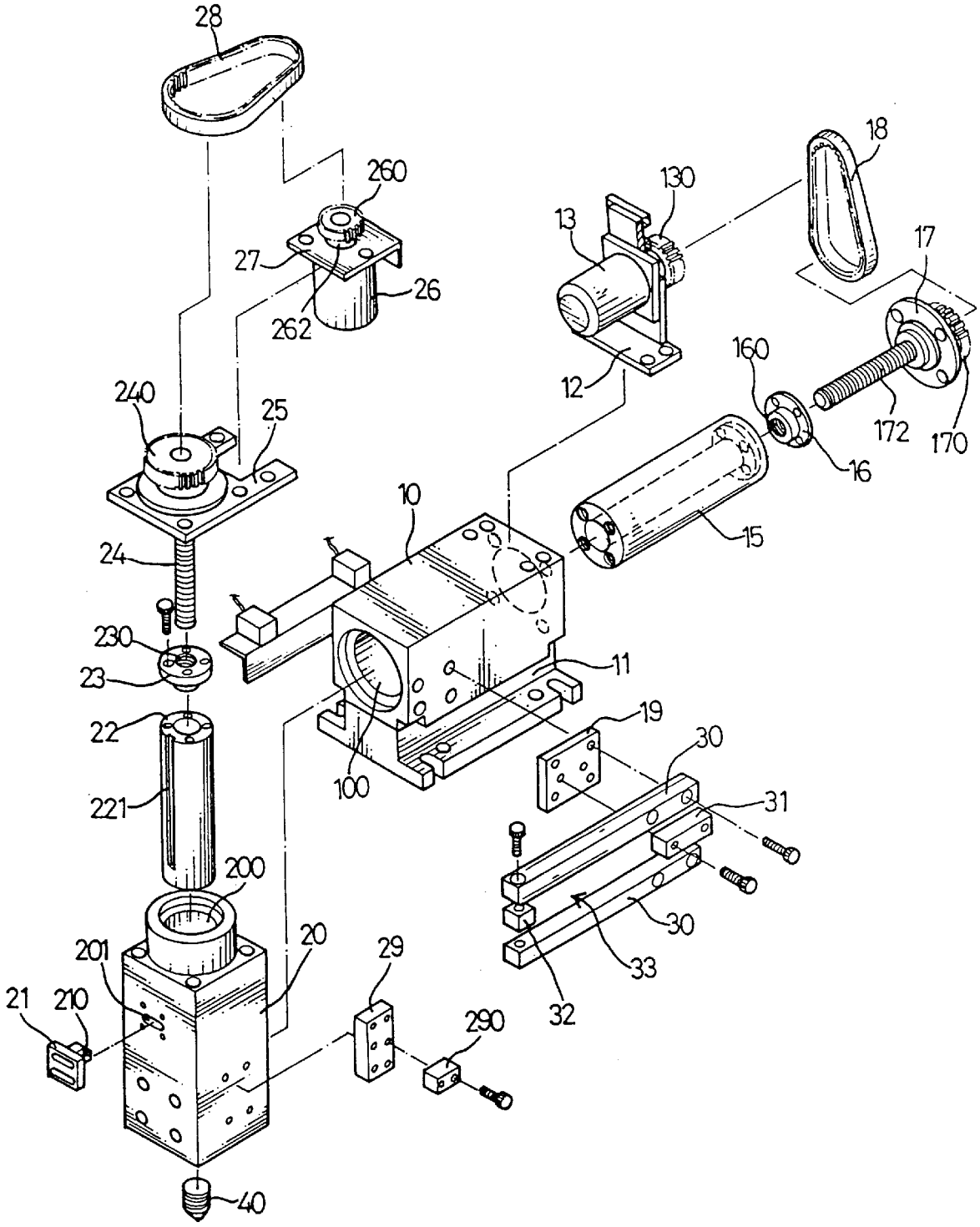
FIG. 2 is an exploded view of the wheel dressing device shown in FIG. 1.
Figure 3:
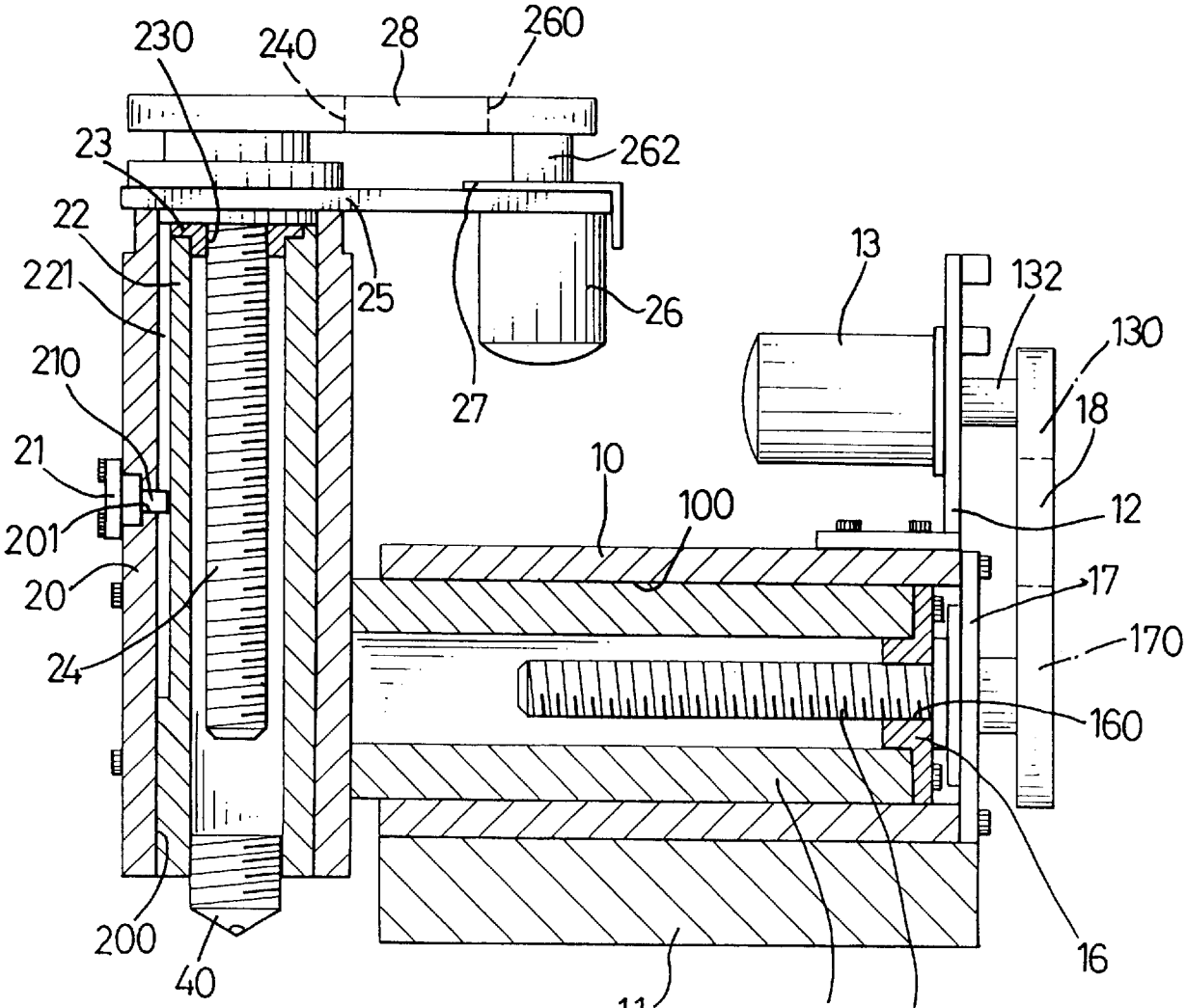
FIG. 3 is a front plan cross-sectional view of FIG. 1.

Referring now to FIGS. 1–3, a wheel dressing device according to a first embodiment of the present invention can be adapted for wheel dressing and finishing a grinding wheel 51 of a grinding machine 50 which includes a fixed wall 54, a hood 52 fixedly mounted on the fixed wall 54 for shielding the grinding wheel 51, and a supporting rack 53 fixedly mounted on the hood 52.

The wheel dressing device comprises a supporting base 10 integrally formed with a bottom portion 11 fixedly mounted on the supporting rack 53 of the grinding machine 50. The supporting base 10 axially defines a first passage 100 therein and includes a first end portion and a second end portion.

A sliding tube 15 is slidably mounted in the first passage 100 and includes a first end portion and a second end portion extending outward of the second end portion of the supporting base 10.

A feed base 20 is fixedly mounted on the second end portion of the sliding tube 15 to move therewith along a horizontal direction. The feed base 20 axially defines a second passage 200 along a direction perpendicular to that of the first passage 100 and includes a first end portion and a second end portion.

A feed tube 22 is slidably mounted in the second passage 200 and includes a first end portion and a second end portion, and a wheel dressing head 40 including a tip made of material such as a diamond is fixedly mounted on the second end portion of the feed tube 22 to move therewith along a vertical direction.

A first bushing 16 is fixedly mounted on the first end portion of the sliding tube 15 to move therewith and axially defines a first threaded bore 160 therein.

An end cap 17 is fixedly mounted on the first end portion of the supporting base 10. A first threaded rod 172 is rotatably mounted in the end cap 17 and includes a first end portion threadedly extending through the first threaded bore 160 and a second end portion extending outward of the end cap 17. A first driven gear 170 is fixedly mounted on the second end portion of the first threaded rod 172.

A first supporting plate 12 is fixedly mounted on the supporting base 10. A first servo motor 13 is fixedly mounted on the first supporting plate 12 and includes a first rotary axle 132 extending through the first supporting plate 12.

A first drive gear 130 is fixedly mounted on the first rotary axle 132 to rotate therewith, and a first toothed belt 18 is reeved around the first drive gear 130 and the first driven gear 170 such that the first driven gear 170 can be rotated by the first drive gear 130.

The feed tube 22 axially defines a first guiding groove 221 along an outer periphery thereof. The feed base 20 transversely defines a slot 201 in an outer periphery thereof and communicating with the first guiding groove 221. A first positioning piece 21 is fixedly mounted on the outer periphery of the feed base 20 and is formed with a first plug 210 extending through the slot 201 and slidably received in the first guiding groove 221.

A second bushing 23 is fixedly mounted on the first end portion of the feed tube 22 to move therewith and axially defines a second threaded bore 230 therein.

A fixed plate 25 is fixedly mounted on the first end portion of the feed base 20. A second threaded rod 24 is rotatably mounted in the fixed plate 25 and includes a first end portion threadedly extending through the threaded bore 230 and a second end portion extending outward of the fixed plate 25. A second driven gear 240 is fixedly mounted on the second end portion of the second threaded rod 24.

A second supporting plate 27 is fixedly mounted on the fixed plate 25. A second servo motor 26 is fixedly mounted on the second supporting plate 27 and includes a second rotary axle 262 extending through the second supporting plate 27.

A second drive gear 260 is fixedly mounted on the second rotary axle 262 to rotate therewith, and a second toothed belt 28 is reeved around the second drive gear 260 and the second driven gear 240 such that the second driven gear 240 can be rotated by the second drive gear 260.

A first abutting board 19 is fixedly mounted on an outer periphery of the supporting base 10. Two elongate beams 30 are disposed in parallel with each other and each include a first end portion fixedly mounted on the first abutting board 19 and a second end portion.

A first stop 31 is fixedly mounted between the first end portions of each of the two elongate beams 30, and a second stop 32 is fixedly mounted between the second end portions of each of the two elongate beams 30. A guiding channel 33 is defined between the two elongate beams 30 and is located between the first stop 31 and the second stop 32.

A second abutting board 29 is fixedly mounted on an outer periphery of the feed tube 20 to move therewith and abuts on each of the two elongate beams 30. A sliding block 290 is fixedly mounted on the second abutting board 29 and is slidably received in the guiding channel 33.

Figure 4:
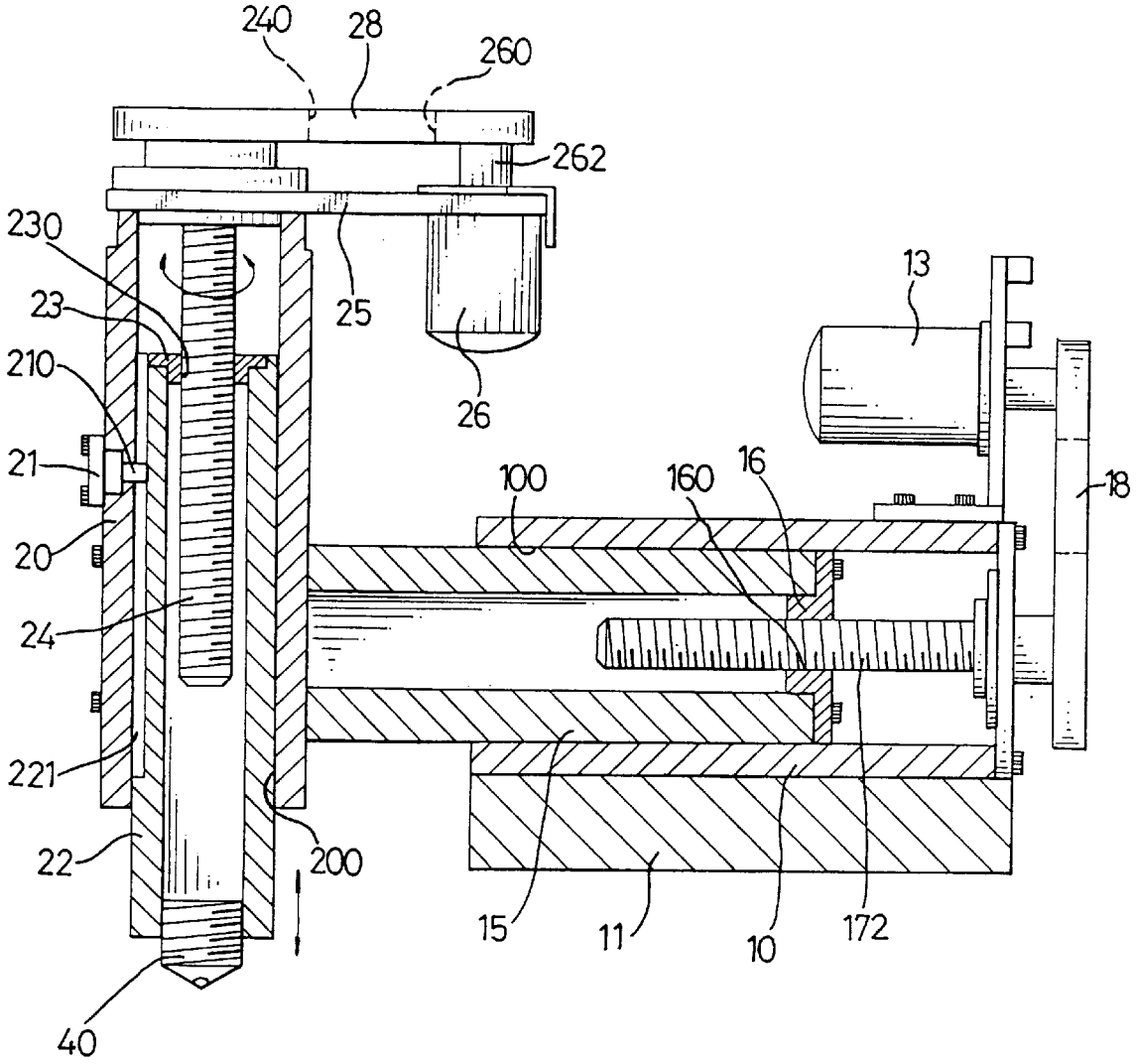
FIG. 4 is an operational view of FIG. 3.

In operation, referring to FIGS. 3 and 4 with reference to FIGS. 1 and 2, the feed tube 22 initially extends through a slot 520 defined in the hood 52 as shown in FIG. 1 such that the wheel dressing head 40 can be disposed above the grinding wheel 51 to be trimmed and finished.

The first drive gear 130 can then be rotated by the first servo motor 13 to rotate the first driven gear 170 by means of the first toothed belt 18, thereby rotating the first threaded rod 172 which can be rotated relative to the first bushing 16 such that the first bushing 16 together with the sliding tube 15 and the feed base 20 can be moved outwardly from a first position as shown in FIG. 3 to a second position as shown in FIG. 4, thereby in turn adjusting a horizontal displacement of the wheel dressing head 40 relative to an outer periphery of the grinding wheel 51 to be trimmed.

The second drive gear 260 can then be rotated by the second servo motor 26 to rotate the second driven gear 240 by means of the second toothed belt 28, thereby rotating the second threaded rod 24 which can be rotated relative to the second bushing 23 such that the second bushing 23 together with the sliding tube 22 can be moved downwardly from a first position as shown in FIG. 3 to a second position as shown in FIG. 4, thereby adjusting a vertical displacement of the wheel dressing head 40 relative to the outer periphery of the grinding wheel 51 to be trimmed.

It is to be noted that, the sliding block 290 together with the feed base 20 is limited to slide along the guiding channel 33 such that the sliding tube 15 together with the first bushing 16 is limited to slide along a horizontal direction and cannot be rotated by the first threaded rod 172.

In addition, the feed tube 22 together with the second bushing 23 is limited to slide along a vertical direction and cannot be rotated by the second threaded rod 24 due to a slide engagement between the first plug 210 and the first guiding groove 221.

Figure 5:
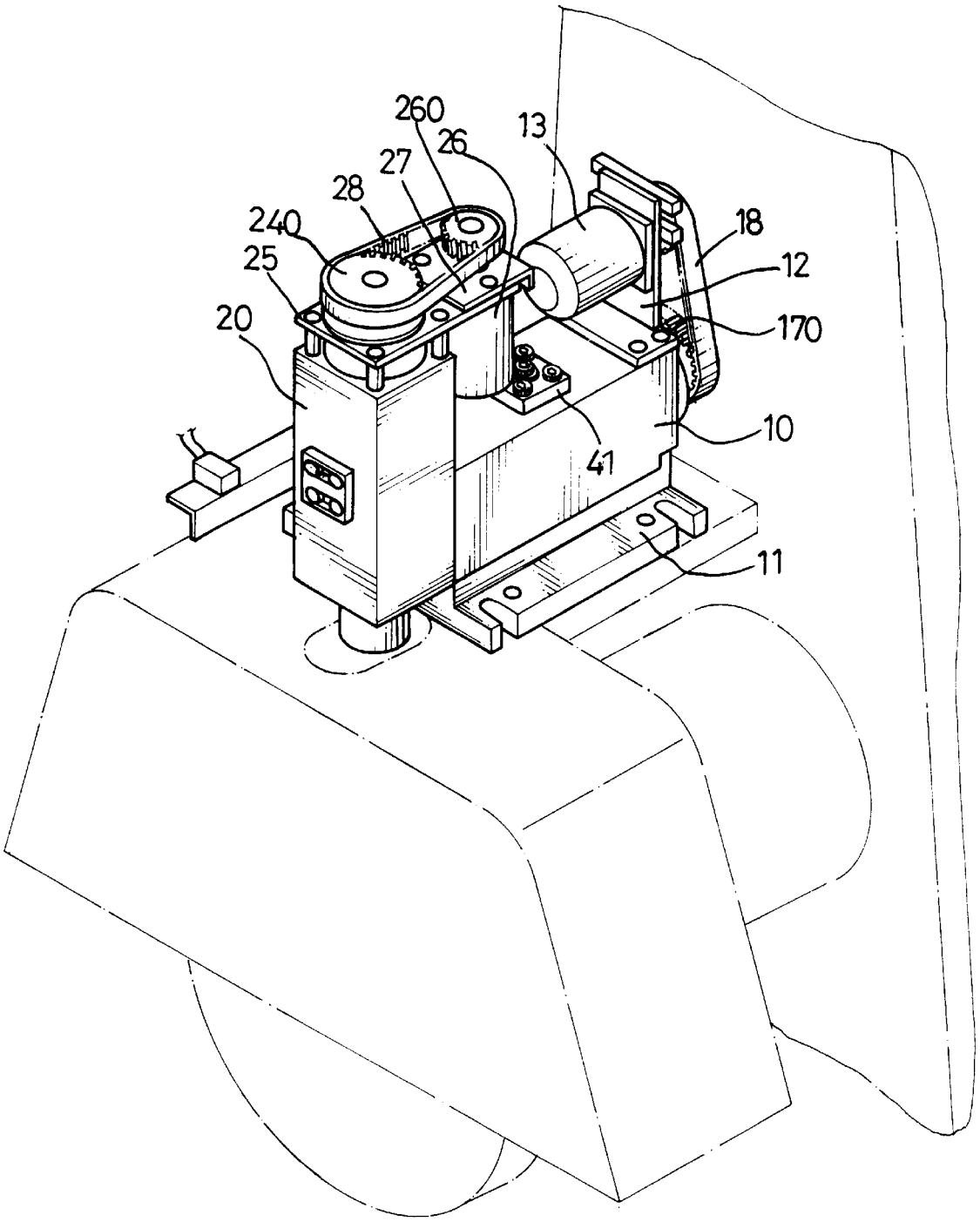
FIG. 5 is a perspective view of a wheel dressing device according to a second embodiment of the present invention.
Figure 6:
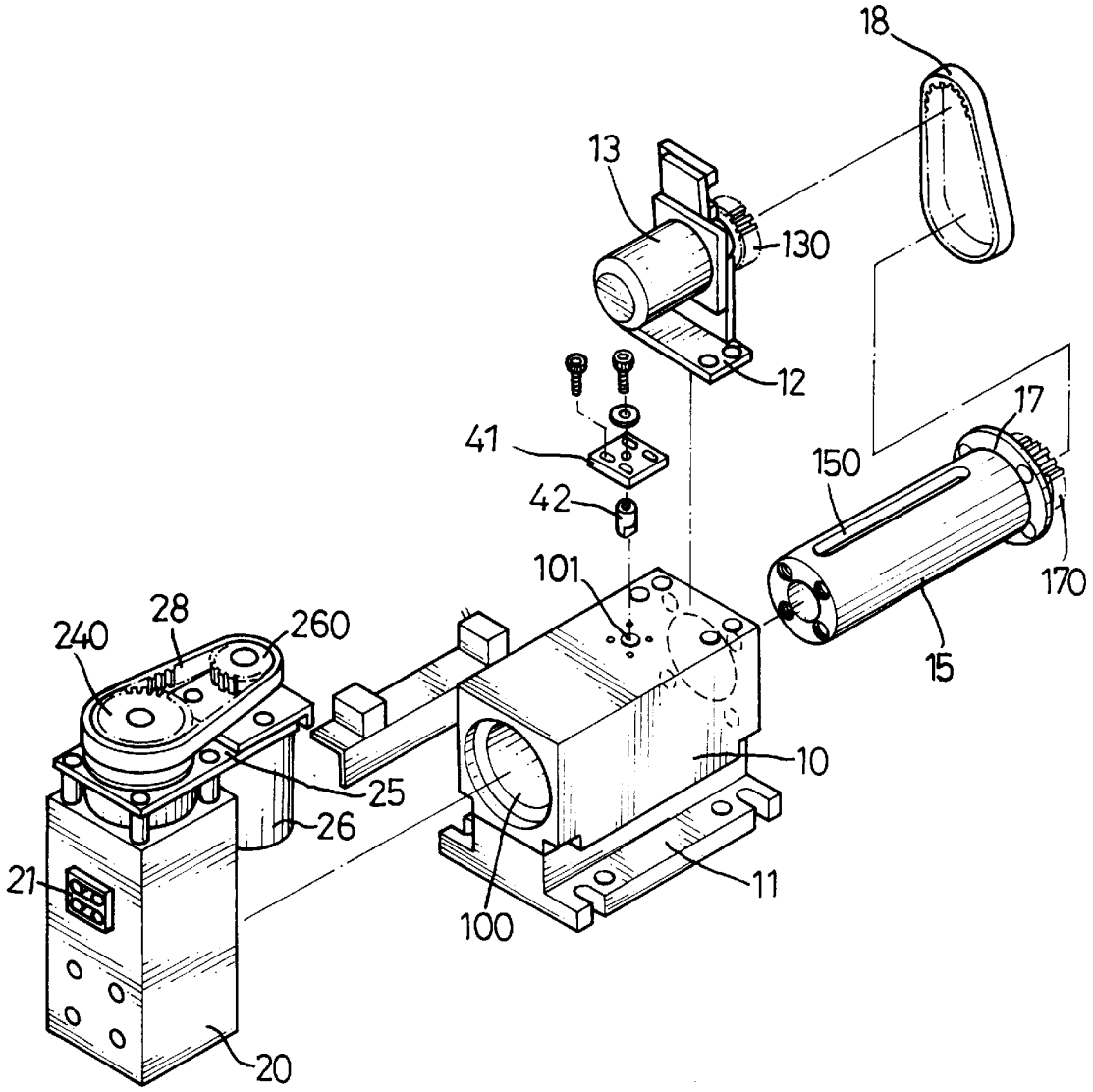
FIG. 6 is a partially exploded view of the wheel dressing device shown in FIG. 5.
Figure 7:
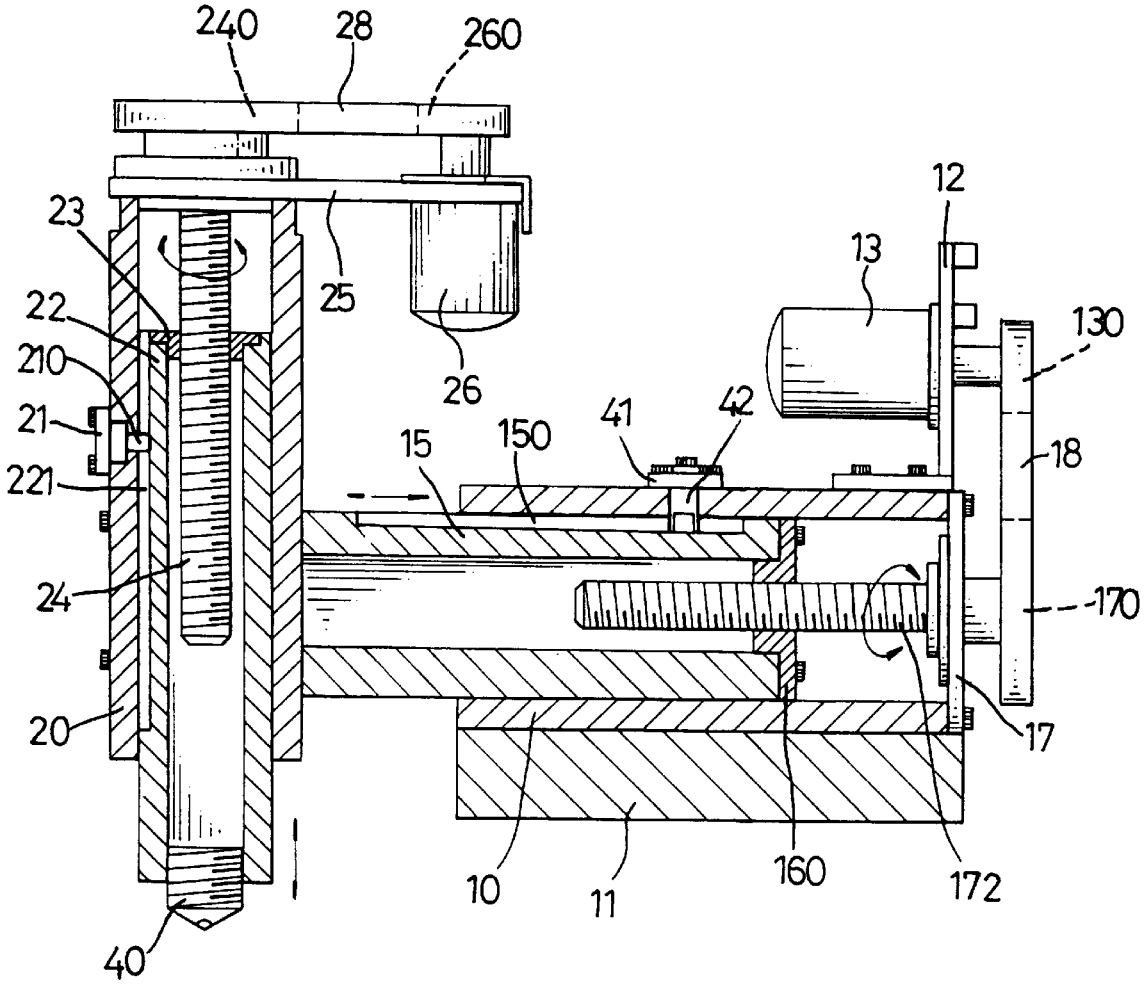
FIG. 7 is a front plan cross-sectional view of FIG. 5.

Referring now to FIGS. 5–7, in accordance with a second embodiment of the present invention, the first and second abutting boards 19 and 29, the two elongate beams 30, the first and second stops 31 and 32, and the sliding block 290 are removed.

The sliding tube 15 axially defines a second guiding groove 150 along an outer periphery thereof, and the supporting base 10 transversely defines a hole 101 in an outer periphery thereof and communicating with the second guiding groove 150.

A second positioning piece 41 is fixedly mounted on the outer periphery of the supporting base 10. A second plug 42 is fixedly mounted on the second positioning piece 41, extends through the hole 101 and is slidably received in the second guiding groove 150.

By such an arrangement, the sliding tube 15 together with the first bushing 16 is limited to slide along the horizontal direction and cannot be rotated by the first threaded rod 172 due to a slide engagement between the second plug 42 and the second guiding groove 150.

It should be clear to those skilled in the art that further embodiments of the present invention may be made without departing from the spirit and scope of the present invention.

What is claimed is:

1. A wheel dressing device comprising:

a supporting base axially defining a first passage therein and including a first end portion and a second end portion;

a sliding tube slidably mounted in said first passage and including a first end portion and a second end portion extending outward of said second end portion of said supporting base;

a feed base fixedly mounted on said second end portion of said sliding tube to move therewith, said feed base axially defining a second passage along a direction perpendicular to that of said first passage and including a first end portion and a second end portion, said feed base transversely defining a slot in an outer periphery thereof;

a feed tube slidably mounted in said second passage and including a first end portion and a second end portion, said feed tube containing a guiding groove axially defined in an outer periphery thereof and communicating with said slot;

a positioning piece fixedly mounted on said outer periphery of said feed base and formed with a plug extending through said slot and received in said guiding groove; and a wheel dressing head fixedly mounted on said second end portion of said feed tube to move therewith.

2. The wheel dressing device according to claim 1, further comprising a first bushing fixedly mounted on said first end portion of said sliding tube to move therewith and axially defining a threaded bore therein, and end cap fixedly mounted on said first end portion of said supporting base, a threaded rod rotatably mounted in said end cap and including a first end portion threadedly extending through said threaded bore and a second end portion extending outward of said end cap, a driven gear fixedly mounted on said second end portion of said threaded rod, a supporting plate fixedly mounted on said supporting base, a servo motor fixedly mounted on said supporting plate and including a rotary axle extending through said supporting plate, a drive gear fixedly mounted on said rotary axle to rotate therewith, and a toothed belt reeved around said drive gear and said driven gear.

3. The wheel dressing device according to claim 1, further comprising a second bushing fixedly mounted on said first end portion of said feed tube to move therewith and axially defining a second threaded bore therein, a fixed plate fixedly mounted on said first end portion of said feed base, a second threaded rod rotatably mounted in said fixed plate and including a first end portion threadedly extending through said second threaded bore and a second end portion extending outward of said fixed plate, a second driven gear fixedly mounted on said second end portion of said second threaded rod, a second supporting plate fixedly mounted on said fixed plate, a second servo motor fixedly mounted on said second supporting plate, and including a second rotary axle extending through second supporting plate, a second drive gear fixedly mounted on said second rotary axle to rotate therewith, and a second toothed belt reeved around said second drive gear and said second driven gear.

4. The wheel dressing device according to claim 1, further comprising a first abutting board fixedly mounted on an outer periphery of said supporting base, two elongate beams disposed parallel with each other and each including a first end portion fixedly mounted on said first abutting board and a second end portion, a first stop fixedly mounted between said first end portions of each of said two elongate beams, a second stop fixedly mounted between said second end portions of each of said two elongate beams, a guiding channel defined between said two elongate beams and located between said first stop and said second stop, a second abutting board fixedly mounted on an outer periphery of said feed tube to move therewith and abutting on each of said two elongate beams, and a sliding block fixedly mounted on said second abutting board and slidably received in said guiding channel.

5. The wheel dressing device according to claim 2, wherein said sliding tube axially defines a second guiding groove along an outer periphery thereof, said supporting base transversely defines a hole in an outer periphery thereof and communicating with said second guiding groove, and said wheel dressing device further comprises a second positioning piece fixedly mounted on said outer periphery of said supporting base, and a second plug fixedly mounted on said second positioning piece, extending through said hole and slidably received in said second guiding groove.

* * * * *